US006433264B1

(12) United States Patent
Gimpel et al.

(10) Patent No.: US 6,433,264 B1
(45) **Date of Patent: *Aug. 13, 2002**

(54) COMPENSATED NUT FOR A STRINGED INSTRUMENT

(75) Inventors: Dudley D. Gimpel, Atascadero; Hans F. Lindauer, Los Osos, both of CA (US)

(73) Assignee: Ernie Ball, Inc., San Luis Obispo, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 102 days.

(21) Appl. No.: 09/199,747

(22) Filed: Nov. 25, 1998

(51) Int. Cl.[7] ..... G10D 3/06
(52) U.S. Cl. ..... 84/314 N; 84/314 N
(58) Field of Search ..... 84/314 N, 314 R

(56) References Cited

U.S. PATENT DOCUMENTS

| | | | | | |
|---|---|---|---|---|---|
| 2,959,085 | A | * | 11/1960 | Porter | 84/314 |
| 4,295,404 | A | | 10/1981 | Smith | |
| 4,464,970 | A | | 8/1984 | Mischakoff | |
| 4,541,320 | A | | 9/1985 | Sciuto | |
| 4,696,219 | A | * | 9/1987 | Plescia | 84/314 N |
| 4,709,612 | A | * | 12/1987 | Wilkinson | 84/314 N |
| D302,563 | S | | 8/1989 | Sirmon et al. | |
| 4,852,450 | A | | 8/1989 | Novak | |
| 4,867,031 | A | | 9/1989 | Fender | |
| 5,404,783 | A | | 4/1995 | Feiten et al. | |
| 5,481,956 | A | * | 1/1996 | LoJacono et al. | 84/314 N |
| 5,600,079 | A | | 2/1997 | Feiten et al. | |
| 5,728,956 | A | | 3/1998 | Feiten et al. | |
| 5,750,910 | A | | 5/1998 | LoJacono | |
| 5,932,822 | A | * | 8/1999 | Bernstein | 84/314 N |

* cited by examiner

*Primary Examiner*—Robert E. Nappi
*Assistant Examiner*—Kim Lockett
(74) *Attorney, Agent, or Firm*—Knobbe, Martens, Olson & Bear, LLP

(57) ABSTRACT

The present invention involves a solid compensated nut for a stringed musical instrument which improves the intonation of each string of the instrument. The compensated nut includes one or more intonation portions on a face of the nut and the intonation portions have different dimensions according to the desired pitch or intonation of the instrument. Desirably, the number of intonation portions is equal to the number of strings of the instrument, and each particular intonation portion is dimensioned to improve the intonation of a particular string. Advantageously, the nut is compensated different amounts according to the desired pitch of a particular string and the compensated nut is especially effective in improving the intonation of the strings near the nut.

29 Claims, 3 Drawing Sheets

COMPENSATED NUT FOR A STRINGED INSTRUMENT

BACKGROUND OF THE INVENTION

1. Field of the Invention

The present invention generally relates to a nut for a stringed musical instrument and, in particular, to a compensated nut for a guitar.

2. Description of Related Art

Lute-type instruments and other stringed musical instruments have been used for many centuries, but proper intonation of each of the strings is very difficult to achieve. The strings of a conventional guitar, for example, are generally not properly intonated and, in fact, it is generally considered not possible to perfectly tune a conventional guitar. These variations in the intonation and tune of a conventional guitar are known in the industry and these deviations are generally accepted. Guitar players, for example, may use assorted playing techniques in an attempt to minimize these variations, but these techniques are difficult to learn, use and master.

Conventional guitars, whether electrical, acoustical or classical, typically have six strings with six different pitches: E, B, G, D, A and E. As known in the art, the acoustical characteristics of the different strings are dependent upon factors such as the gauge or diameter of the string, the tension of the string, the material of which the string is constructed, and whether the string is wound or plain. Typically the lower pitch strings are wound strings and the higher pitch strings are plain strings.

Standard guitars have a body, elongated neck, finger board, bridge, nut and a series of frets positioned along the neck. The frets are ridges of material such as metal or wood which extend outwardly and generally perpendicularly across the finger board of the guitar. The frets are typically positioned according to a mathematical formula called the "Rule of 18" which is used to determine the position of the frets. The frets allow for other notes and chords to be played when the guitar player's fingers press down on the desired guitar strings at the selected frets locations between the bridge and the nut. As known in the industry, the Rule of 18 is imprecise and it does not result in perfect intonation of each string at each fret location. Most guitar players, however, prefer that their instruments intonate correctly so that each string is equally in tune at all points along the keyboard or finger board.

Conventional guitars may include an adjustable bridge to improve the tuning of the guitar. For example, U.S. Pat. No. 4,541,320 issued to Sciuto and U.S. Pat. No. 4,861,031 issued to Fender disclose adjustable bridges which allow individual strings to be adjusted and intonated. In particular, the adjustable bridges provide a means for allowing each string to be adjustably compensated according to its length, tension, diameter and material that comprises the string.

U.S. Pat. No. 5,404,783 issued to Feiten, et al., discloses an adjustable bridge with individual adjustable saddles. Each saddle is located in a groove or trough and each saddle includes a threaded capture which receives a screw. The screws are connected to a transverse boss which extends substantially perpendicular to the strings. Turning a particular screw causes the connected saddle to move in a direction longitudinally to the strings to adjust the intonation of that string. Specifically, the saddle element upon which the particular string rests is longitudinally adjusted utilizing an allen wrench to turn the screw thereby longitudinally adjusting the saddle element in relation to the string. As the screw is turned, the saddle is physically adjusted by virtue of the threaded connection between the screw and the saddle. The Feiten patent explains that testing and continuous adjusting of the bridge is repeated until the intonation of the fretted string matches the intonation of the open string. This method then has to be repeated for all other strings.

U.S. Pat. No. 5,481,956 issued to LoJacono, et al., discloses a guitar tuning apparatus with an adjustable bridge including a plurality of adjustable saddle bridge members and a nut having a plurality of adjustable nut saddle members. The adjustment of both the bridge and nut determines the length of each string and the longitudinal position of each string. In particular, the adjustable bridge has the plurality of adjustable saddle members secured to the body of the guitar and the nut has a sinusoidal configuration with a plurality of adjustable nut saddle members mounted in a nut frame. The number of saddles in the nut and bridge correspond to the number of strings of the guitar, and the bridge and saddle members are adjusted to establish as true an intonation of each string as possible. The LoJacono patent, however, discloses a complex structure with multiple parts that requires adjustment of each individual string at both the nut and bridge of the guitar. Disadvantageously, this complex structure is subject to rattles, goes out of tune, requires periodic adjustments, and increases the costs of the guitar.

U.S. Pat. No. 4,295,404 issued to Smith discloses a compensated nut for a lute-type instrument. The nut includes an overhang or extending portion that extends over a portion of the finger board and the overhang portion is tapered to give greater compensation to the strings of wider diameter. In particular, the overhang portion extends from 1/64 of an inch over the first E string and it tapers at a constant rate to an extension of 1/32 of an inch over the sixth E string. The overhang increases as the diameter of the string increases, thus the bass strings receive more compensation to compensate for their bulk and achieve the desired tone. Disadvantageously, this device is only a compromise solution because the extended portion of the nut is tapered at a constant rate from the treble side to the bass side of the instrument and the device does not account for strings with different core sizes and diameters.

SUMMARY OF THE INVENTION

A need therefore exists for a stringed musical instrument which provides better intonation and eliminates the above-described problems.

One aspect of the present invention is a compensated nut for a stringed musical instrument with a body, a neck and one or more strings. The compensated nut includes an elongated body with a front side, a back side, a top side, and a bottom side, and the elongated body is configured to extend across at least a portion of the neck of the instrument. The nut also includes one or more intonation portions on the front side of the elongated body and the intonation portions have different dimensions according to the desired pitch or intonation of the instrument. Desirably, the number of intonation portions is equal to the number of strings of the instrument, and each intonation portion is sized and dimensioned to improve the intonation of a particular string.

In one embodiment, the intonation portions desirably comprise cut-out sections found in the front side of the compensated nut. As one example, the cut-out sections preferably have a depth between about 0.001 inches (0.003 cm) and about 0.100 inches (0.254 cm), and the cut-out sections include a first side wall and a second side wall. The side walls are preferably generally parallel and joined by a lower surface. More preferably, the side walls are between about 0.010 inches (0.025 cm) and about 0.200 inches (0.508 cm) in length, and the walls extend to the top surface of the nut. The compensated nut desirably includes a slot for each string of the instrument and each slot is preferably located within a cut-out section.

The present invention is a compensated nut which improves the intonation of each string of a musical instrument such as a guitar. Advantageously, the nut is compensated different amounts according to the desired pitch of a particular string. Additionally, the compensated nut is especially effective in improving the intonation of the strings near the nut. Further, the compensated nut is suitable for use with a wide range of different guitars and other types of stringed musical instruments.

Another aspect of the present invention is a guitar with a body, neck, a bridge and compensated nut. The compensated nut includes an elongated body which extends across at least a portion of the neck of the guitar and the elongated body includes a plurality of intonation portions having different dimensions according to the desired pitch of the guitar. The guitar also includes a plurality of strings passing over the bridge and the nut, and a plurality of tuning keys attached to the neck. One end of each of the strings is attached to the body and/or the bridge and the other end of the string attached to a tuning key. As known, the tuning keys are adapted and configured to adjust the tension in the plurality of strings. Desirably, the compensated nut has a front side, a back side, a top side, and a bottom side, and the intonation portions are located at least partially in the front side of the elongated body. Additionally, the number of intonation portions in the compensated nut is preferably equal to the number of guitar strings.

The present invention is advantageously simple to manufacture because it consists of a single, solid component. This significantly reduces manufacturing costs. In addition, the compensated nut is easy to install and this reduces labor costs. Further, in contrast to the designs of conventional intonating devices, the present invention results in a more reliable and better sounding instrument which does not require any adjustments and it does not go out of tune. Thus, the compensated nut of the present invention improves both the reliability and sound of the guitar.

The present invention is also practical because of the ease of manufacturing, installation and use. In addition, the present invention can be used to improve the tuning of many different types and configurations of guitars, and it can be used with other types of lute or stringed instruments. Thus, for simplicity, the word "guitar" is used to represent all types of string instruments or lute-type instruments, and it will be understood that the present invention can be used with many different various musical instruments.

Another aspect of the present invention is a lute-type instrument with a body, a bridge, a neck attached to the body and a compensated nut connected to the neck. The compensated nut has a front side and a bottom side, and the nut includes one or more cut-out sections on the front side. The lute-type instrument also includes a plurality of strings extending from the bridge to the nut. Preferably, the bottom side of the nut contacts the neck of the instrument and the front side of the nut faces the body of the instrument. In addition, the cut-out sections desirably have different dimensions according to the desired pitch of the instrument and the number of cut-out sections in the nut is equal to the number of strings of the instrument.

Significantly, the present invention is easy to service and maintain because there are not moving parts and no adjustment of the device is required. Additionally, existing guitars can be readily retrofitted with the compensated nut and the compensated nut may be easily replaced. Further, the compensated nut may be easily modified according to the type of instrument.

Still another aspect of the present invention is a method of tuning an instrument with a body, a neck, a bridge and a plurality of strings. The method includes mounting a nut to the neck of the instrument, the nut having an elongated body with a front side, a back side, a top side, and a bottom side. The elongated body of the nut preferably has a length sufficient to extend across at least a portion of the neck of the instrument and the nut includes one or more intonation portions on the front side of the elongated body. The intonation portions have different dimensions according to the desired pitch of the instrument. The method also includes extending the strings from the bridge to the nut and attaching the strings to the bridge and the head of the instrument.

Yet another aspect of the present invention involves a nut for a stringed instrument. The nut comprises a substantially unitary elongated body, the body having a length sufficient to extend across at least a portion of the neck of the stringed instrument, a plurality of slots across the elongated body configured to position corresponding strings, a plurality of string termination points along the elongated body, each termination point corresponding to one of the plurality of slots, at least one of the string termination points offset in distance from another of the termination points with respect to a line perpendicular to the strings positioned by the slots. In one embodiment, at least three of the plurality of string termination points are offset from each other with respect to the perpendicular line, and in another embodiment, the offset is non-linear from termination point to termination point.

Further aspects, features and advantages of the present invention will become apparent from the detailed description of the preferred embodiments that follows.

BRIEF DESCRIPTION OF THE DRAWINGS

The appended drawings contain figures of a preferred embodiment of the present compensated guitar nut. The above-mentioned features of the compensated guitar nut, as well as other features, will be described in connection with the preferred embodiment. However, the illustrated embodiment is only intended to illustrate the invention and not limit the invention. The drawings contain the following figures.

DETAILED DESCRIPTION OF THE PREFERRED EMBODIMENT

The present invention involves a compensated nut for a lute-type instrument such as a guitar. In the present embodiment, the nut is a single piece and of solid structure. The principles of the present invention, however, are not limited to guitars. It will be understood that, in light of the present disclosure, the compensated nut disclosed herein can be successfully used in connection with other types of lute or stringed musical instruments.

Additionally, to assist in the description of the compensated nut, words such as top, bottom, front, rear, right and left are used to describe the accompanying figures. It will be appreciated, however, that the present invention can be located in a variety of desired positions—including various angles, sideways and even upside down. A detailed description of the compensated nut now follows.

Figure 1:
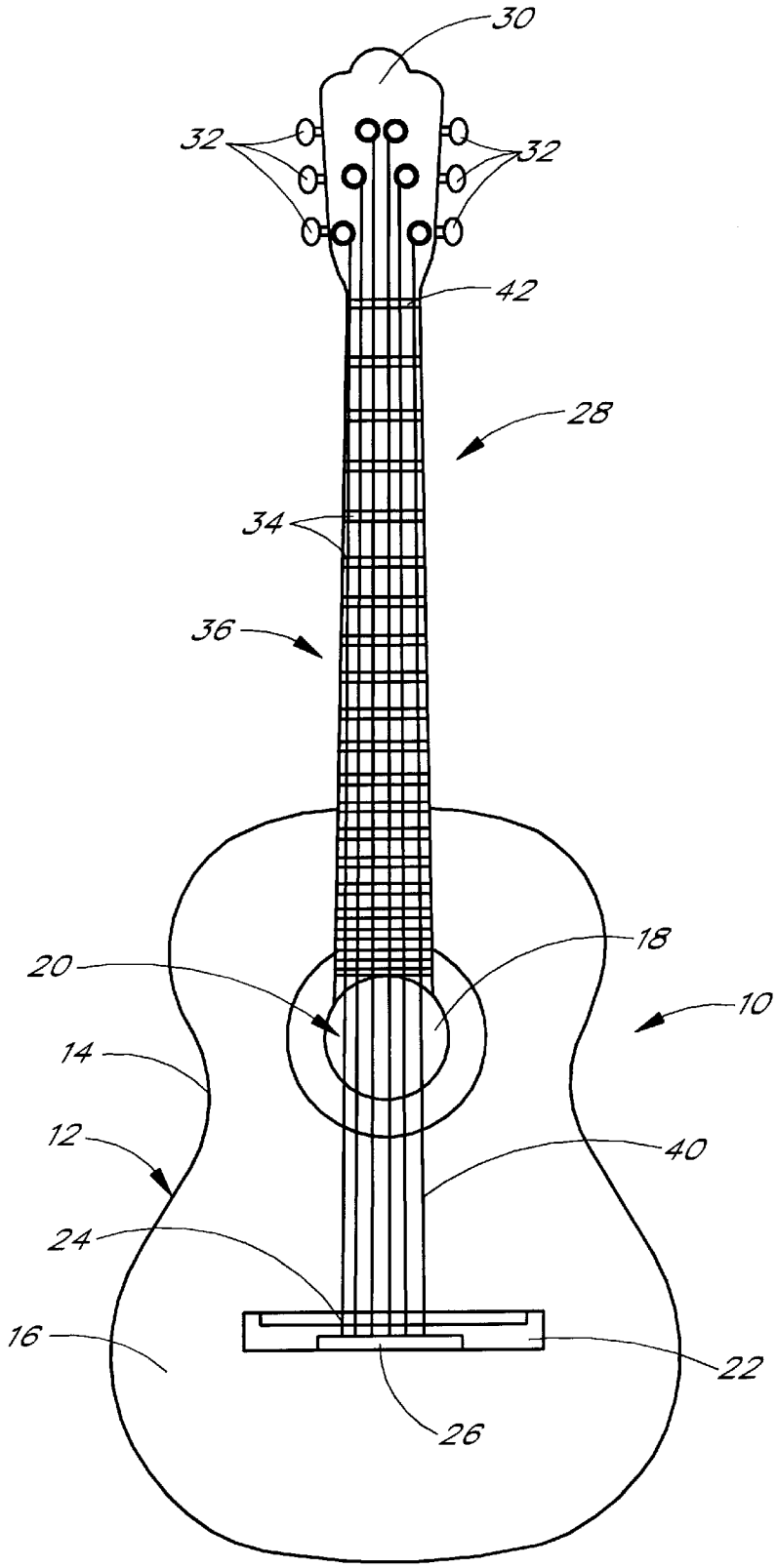
FIG. 1 is a top view of a conventional acoustic guitar with a body, neck, finger board, bridge, nut and a series of frets.

As seen in FIG. 1, the basic configuration of a conventional acoustic guitar 10 includes a guitar body 12 with sides 14 and a top or sound board 16. The sound board 16 includes an opening 18 to a resonant cavity or sound hole 20 and attached to the sound board is a bridge 22. The bridge 22 preferably includes a plurality of slots 24 and string anchor portions 26. Attached to the guitar body 12 is a neck 28 and attached to the distal end of the neck is a head 30 with one or more tuning keys or string tighteners 32. A series of frets 34 extend perpendicularly across the neck 28 at designated intervals to form the fret board or finger board 36. Conventional guitars generally have from 20–24 frets, but the guitar may have any number of desired frets. As set forth in the background of the invention, the frets are conventionally positioned according to the Rule of 18, but the frets can be positioned in any desired locations at any desired spacings.

The conventional guitar 10 shown in FIG. 1 includes six strings 40 and one end of each string is mounted to the bridge 22 located near the resonant cavity 20 and the other end of the string extends over the nut 42 located near the distal end of the neck 30 and it is attached to a tuning key 32. As known in the art, the guitar 10 can have many different designs including, for example, a body 12, neck 28, head 30 and/or tuning keys 32 of various shapes, sizes and configurations. The guitar 10 can also be, for example, a classical or electric guitar and, for simplicity, the word "guitar" could be replaced with any lute-type or stringed instrument.

The strings 40 of the guitar 10 shown in the accompanying figures are preferably each tuned to a different pitch, desirably E, B, G, D, A, and E, but the strings can be tuned to any desired pitch and even the same pitch. The strings 40 preferably vary in diameter from about 0.009 inches (0.022 cm) to about 0.046 inches (0.117 cm), and more preferably the strings have an approximate diameter of 0.009 inches (0.022 cm), 0.011 inches (0.028 cm), 0.016 inches (0.041 cm), 0.024 inches (0.061 cm), 0.036 inches (0.091 cm) and 0.042 inches (0.101 cm), but the strings can have any desired diameter. Additionally, the strings may be from a Super Slinky set manufactured by Ernie Ball Inc. of San Luis Obispo, Calif., but any type strings may be used. Further, the strings may have any desired length or tension, and the strings may be constructed from any desired material such as steel or nylon.

Figure 2:
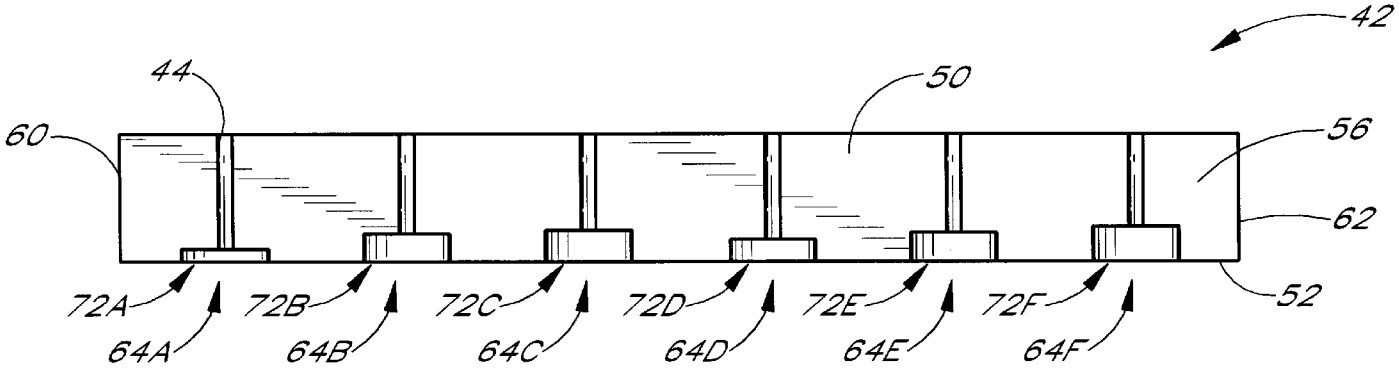
FIG. 2 is a top view of the compensated nut in accordance with a preferred embodiment of the present invention.
Figure 3:
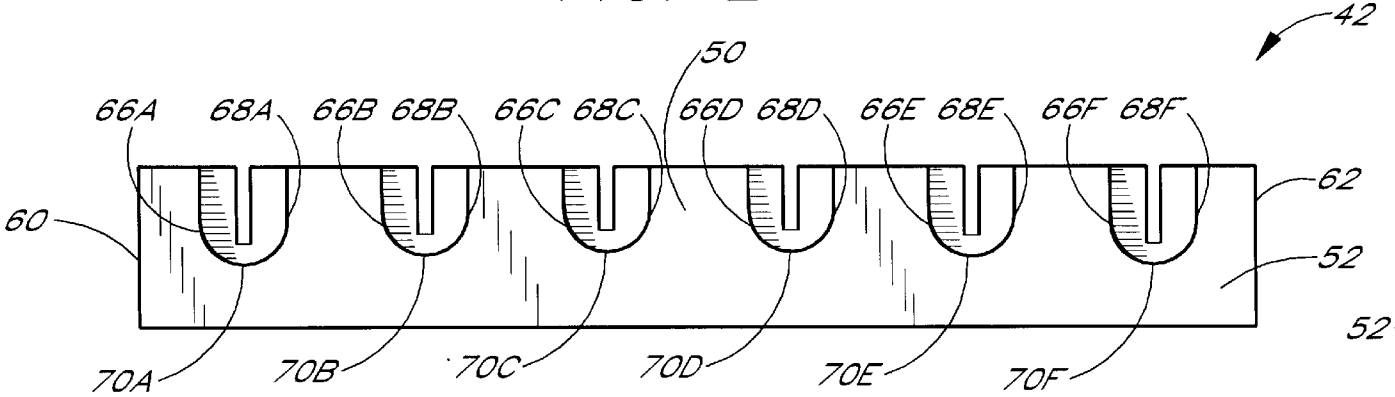
FIG. 3 is a front view of the compensated nut shown in FIG. 2.
Figure 4:
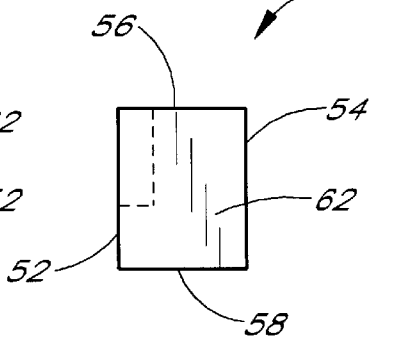
FIG. 4 is a right side view of the compensated nut shown in FIG. 2.

The nut 42 of the guitar 10 is typically constructed from bone, but it can also be constructed from other materials such as plastic, ivory, graphite, composite materials, metal, and other suitable materials. The nut 42 is located at the end of the finger board 36 just before the head 30. As best seen in FIGS. 2 and 3, the nut 42 includes a plurality of slots 44 which are configured to receive the strings 40 of the guitar. For example, the nut 42 shown in the accompanying figures has six slots 44 for use with a conventional guitar with six strings 40, but it will be understood that the nut may have any number of slots depending, for example, upon the number of strings of the guitar. The slots 44 are preferably generally parallel and spaced approximately an equal distance apart, but the slots 44 can be located at any desired orientation and separated by any desired distance. As discussed below, the slots 44 preferably have a width between about 0.020 inches (0.127 cm) and about 0.100 inches (0.254 cm), but the slots can be larger or smaller. Of course, the nut 42 can also be constructed without any slots 44.

Figure 5:
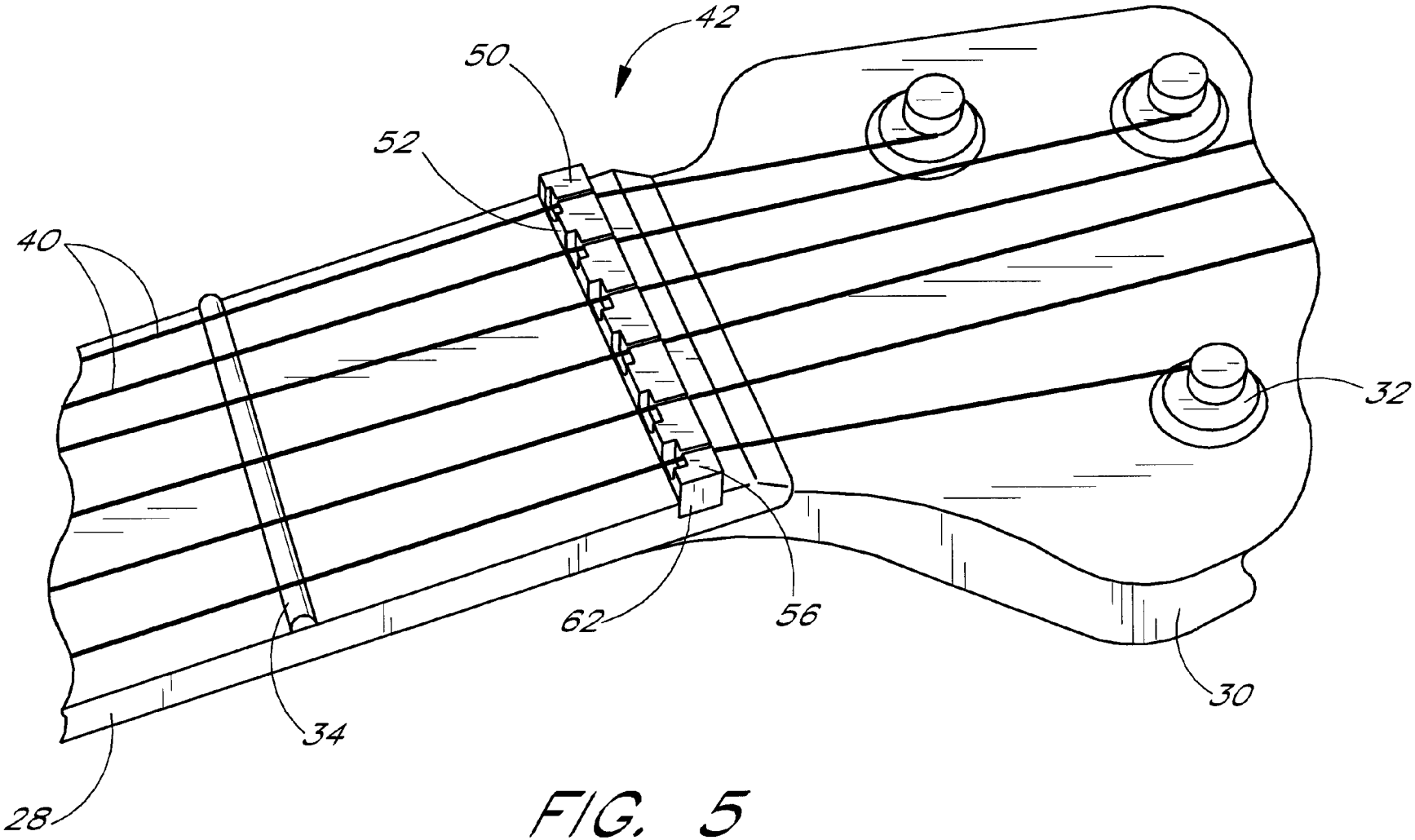
FIG. 5 is an enlarged perspective view of the compensated nut shown in FIG. 2, illustrating the nut with a portion of a conventional guitar.

As seen in FIGS. 2, 3 and 5, the nut 42 includes an elongated body 50 with a generally rectangular configuration having a front side 52, rear side 54, top side 56 and bottom side 58. The nut 42 also includes a left side 60 and a right side 62. The nut 42 preferably has a thickness measured from the front side 52 to the rear side 54 of about 0.187 inches (0.481 cm), a height measured from the bottom side 58 to the top side 56 of about 0.234 inches (0.594 cm), and a length measured from the left side 60 to the right side 62 of about 1.650 inches (4.191 cm), but the nut can have any desired dimensions. It will be appreciated that the nut 42 can have any desired shape such as square or cylindrical, and the nut can have any desired cross section such as circular, elliptical, oblong, triangular, etc. Further, while the sides 52, 54, 56, 58, 60 and 62 of the body 50 are preferably joined at approximately right angles, respectively, the sides can also be tapered and/or positioned at any desired angle. As shown in FIG. 5, the nut 42 is positioned with the bottom side 58 contacting and abutting the finger board 36 of the guitar 10, the front side 52 facing the body 12 of the guitar and the rear side 54 facing the head 30.

The front side 52 of the nut 42 includes a plurality of intonation portions such as cut-outs 64. The nut 42 preferably has the same number of cut-outs 64 as strings 40 for the guitar 10. For example, as shown in the accompanying figures, the nut 42 has six cut-outs 64 for use with the guitar 10 having six strings 40, but it will be understood that the nut may have any desired number of cut-outs depending, for example, upon the number of strings of the guitar. Preferably, the cut-outs 64 have generally the same configuration but different dimensions depending, for example, upon the desired pitch and intonation of the corresponding string. One or more of the cut-outs 64 may also have the same size or different sizes, and each string does not require a cut-out. Alternatively, the intonation portions may include projections or extensions which extend outwardly from the nut 42, or a combination of inwardly and outwardly extending portions. In sum, the nut provides a termination point for each of the strings that defines a distance from the bridge to the termination point (the effective string length). In one embodiment, the termination points differ between at least two of the termination points, and possibly between each termination point. In other words, the intonation cut-outs or termination points provide for different effective lengths of each string, if necessary. The offsets from string to string may be linear or non-linear with respect to the bridge or with respect to a line perpendicular to the strings positioned by the nut.

Although experimentation is the presently preferred method of determining the particular sizing of a particular compensated nut for each guitar, string type and tuning, an embodiment is disclosed below for a nut which the inventors constructed.

As shown in FIGS. 2 and 3, the cut-outs 64 have generally straight side walls 66 and 68 with a curved lower surface 70 on the front side 52 of the nut 42, and an upper opening 72 in the top side 56 of the nut, but the cut-outs may have any desired shape, configuration or location. The cut-outs 64 preferably have an opening 72 which is between about 0.050 inches (0.127 cm) and about 0.200 inches (0.508 cm) in length; the side walls 66 and 68 preferably have a height between about 0.020 inches (0.051 cm) and about 0.200 inches (0.508 cm); and a depth between about 0.001 inches (0.003 cm) and about 0.150 inches (0.381 cm). More preferably, as measured from the left side 60 of the nut 42, the first cut-out 64A has an opening 72A which is about 0.125 inches (0.318 cm) in length and the center of the cut-out is about 0.150 inches (0.381 cm) from the left side of the nut. The side walls 66A, 68A have a height of about 0.080 inches (0.203 cm) and the cut-out 64A has a depth of about 0.021 inches (0.053 cm). The second cut-out 64B has an opening 72B which is about 0.125 inches (0.318 cm) in length and the center of the cut-out is about 0.420 inches (1.067 cm) from the left side 60 of the nut 40. The side walls 66B, 68B have a height of about 0.660 inches (0.168 cm) and the cut-out 64B has a depth of about 0.043 inches (0.109 cm).

The third cut-out 64C has an opening 72C which is about 0.125 inches (0.318 cm) in length and the center of the cut-out is about 0.690 inches (1.752 cm) from the left side 60 of the nut 40. The side walls 66C, 68C have a height of about 0.058 inches (0.147 cm) and the cut-out 64C has a depth of about 0.044 inches (0.112 cm). The fourth cut-out 64D has an opening 72D which is about 0.125 inches (0.318 cm) in length and the center of the cut-out is about 0.960 inches (1.580 cm) from the left side 60 of the nut 42. The side walls 66D, 68D have a height of about 0.058 inches (0.147 cm) and the cut-out 64D has a depth of about 0.034 inches (0.086 cm).

The fifth cut-out 64E has an opening 72E which is about 0.125 inches (0.318 cm) in length and the center of the cut-out is about 1.230 inches (3.124 cm) from the left side 60 of the nut 42. The side walls 66E, 68E have a height of about 0.066 inches (0.168 cm) and the cut-out 64E has a depth of about 0.044 inches (0.112 cm). The sixth cut-out 64F has an opening 72F which is about 0.125 inches (0.318 cm) in length and the center of the cut-out is about 1.500 inches (3.81 cm) from the left side 60 of the nut 42. The side walls 66F, 68F have a height of about 0.080 inches (0.203 cm) and the cut-out 64F has a depth of about 0.052 inches (0.132 cm). It will be understood that the cut-outs 64A–F may be larger or smaller, and the cut-outs, may vary in size and configuration, for example, according to the desired pitch and sound of a particular string.

The compensated nut 42 of the present invention is particularly advantageous because cut-outs 64A–F are sized and configured according to the pitch of each individual string 40 of the guitar 10. In particular, Applicant determined the amount of compensation of the nut 42 by testing the commonly used string gauges for each pitch string on a typical guitar 10. The testing revealed that strings of the wound or plain type but different gauges, tuned to the same pitch, require similar amounts of compensation, and that a string tuned to a lower pitch requires a different amount of compensation than the same string tuned to a higher pitch. Additionally, the testing indicated that wound strings require different amounts of compensation than plain strings. That is, two strings of the same diameter, one wound and one plain, require different amounts of compensation when tuned to the same pitch.

The testing involved placing a string on a guitar and bringing the string into tune by known means, such as connecting a strobe tuner to the output of the guitar. The bridge was intonated in a conventional manner by adjusting the bridge until the second harmonic of the string was in tune with the middle fret position. The fret positions for substantially perfect intonation (referred to as intonation points) of each note along the string were then determined. This process was repeated for different strings types and the locations of the twenty-four fret positions for substantially perfect intonation was determined.

The fret positions for substantially perfect intonation of each note for each string was then compared with the standard fret positions and this comparison revealed that the largest intonation errors occurred at the first few fret positions closest to the nut and the amount of the intonation errors decreased as the distance from the nut increased. In particular, the magnitude of the fret intonation error was greatest for the first five fret positions.

In order to determine the amount of compensation to be applied to the nut to bring the first fret position of a standard guitar into tune, the distance between the first fret position as determined by the Rule of 18 and the experimentally determined intonation point for the first fret was scaled by a factor so as to move that intonation point directly over the fret when the nut is compensated. This factor takes into account that any compensation which is applied to the nut end of the guitar must also be applied to the bridge end of the guitar in order to keep the 12th fret position intonated. The amount of compensation is given by the equation:

$$c = d\frac{L/2}{L/2 - l} = \frac{d}{l - 2l/L}$$

where:

c=the amount of compensation to be applied to the nut d=the distance between the first fret position and the intonation point L=the normal scale length l=the distance between the nut and the first fret This amount of compensation works out to approximately (9/8)d to compensate the nut of an instrument with frets positioned by the Rule of 18.

In one embodiment, the inventor found that a good general compensating nut compensated the following amounts to properly intonate the first fret under many circumstances for a guitar with a 25–½" scale:

| String | Compensation Amount |
|---|---|
| E | .042" |
| A | .020" |
| D | .018" |
| G | .029" |
| B | .018" |
| E | .011" |

Experimentation indicated that the intonation of each string of the guitar was greatly improved with the nut described above, especially for the first five fret positions. The compensation amounts determined above are consistent with the fact that for a given string length, a larger diameter core wire will produce a greater increase in string tension than a smaller core wire when stretched a given amount, as happens when a note is fretted on the guitar. Significantly, the compensated nut of the present invention improves the intonation of each guitar string because the amount of compensation for each guitar string is individually determined. In contrast, prior guitar nuts that applied the same compensation uniformly across all the strings do not allow the individual strings to be correctly compensated.

Additionally, prior solid guitar nuts do not account for the step in core wire sizes.

It will be appreciated that while the compensated nut of the present invention improves the intonation of the individual strings of the guitar, some variation in the intonation of the strings may exist, for example, because of variations in the string tension and the varying distance between the nut and the bridge. Thus, conventional tuning techniques such as using a strobe tuner or tuning by ear may further improve the tuning of the guitar.

One skilled in the art will recognize that the amount of compensation may vary, for example, but without limitation, upon the type of string, string tension and desired notes to be played. Additionally, the compensation of the nut may be directed towards improving the intonation of other or additional frets positions. Further, for example, the amount of compensation for the nut may be determined by substantially perfectly intonating the guitar at the $12^{th}$ fret position to the second harmonic or substantially perfectly intonating the guitar at the $24^{th}$ fret position to the fourth harmonic.

As discussed above, a given compensated nut is designed for a specific scale length and string set at special tuning, but by applying the principles of the invention disclosed herein, different scale lengths with different amounts of compensation could be determined. Thus, a compensated nut may be manufactured with particular dimensions and sizes for a particular instrument or desired sound, and a different compensated nut may be constructed with different dimensions for different instruments and/or desired sounds. The nut of the guitar can be used alone or in combination with other devices, such as various bridges. In addition, the nut need not be entirely solid, and the principals of the present invention could be incorporated into a multi-piece nut.

Furthermore, although the invention described above is described in terms of a compensated nut, for stringed instruments with a "zero" fret and separate string guides, the zero fret could incorporate the compensated features described for the nut.

Although this invention has been described in terms of a certain preferred embodiment, other embodiments apparent to those of ordinary skill in the art are also within the scope of this invention. Accordingly, the scope of the invention is intended to be defined only by the claims which follow.

What is claimed is:

1. A compensated nut for a stringed instrument, the stringed instrument having one or more strings, a body and a neck, the nut comprising:

an elongated body having a length sufficient to extend across at least a portion of the neck of the stringed instrument; and one or more fixed intonation portions on a front side of the elongated body, the intonation portions having different dimensions according to the desired pitch compensation for each string and being configured such that a line extending through the one or more fixed intonation portions does not form a sinusoidal arc.

2. The compensated nut of claim 1, wherein the number of intonation portions are equal to the number of strings of the instrument.

3. The compensated nut of claim 1, further including one or more slots extending along at least a portion of a top side of the nut, each of the slots configured to receive one of the strings of the instrument.

4. The compensated nut of claim 3, wherein each of the slots is aligned with one of the intonation portions.

5. The compensated nut of claim 1, wherein the intonation portions are cut-out sections which have a depth between about 0.001 inches and about 0.150 inches.

6. The compensated nut of claim 1, wherein the intonation portions are cut-out sections which include a first side wall and a second side wall located in the front side of the elongated body of the compensated nut.

7. The compensated nut of claim 6, wherein the side walls are generally parallel and the side walls are joined by a lower surface.

8. The compensated nut of claim 6, wherein the side walls are between about 0.010 inches and about 0.200 inches in length.

9. The compensated nut of claim 6, wherein the side walls are generally the same length and the side walls are joined by a curved lower surface.

10. The compensated nut of claim 1, wherein the intonation portions include an opening in the top surface of the nut.

11. The compensated nut of claim 1, wherein the intonation portions comprise a plurality of projections that extend outwardly from the nut.

12. A guitar, comprising:

a body;

a neck connected to the body;

a bridge connected to the body;

a compensated nut connected to the neck, the compensated nut including an elongated body with a length sufficient to extend across at least a portion of the neck of the guitar, the elongated body having a plurality of fixed intonation portions with different dimensions according to the desired pitch of the stringed instrument and the plurality of fixed intonation portions being configured such that a line extending through the plurality of fixed intonation portions does not form a sinusoidal arc;

a plurality of strings passing over the bridge and the nut; and a tuning key attached to each string, the tuning keys adapted and configured to adjust the tension in the plurality of strings.

13. The guitar of claim 12, wherein the compensated nut has a front side, a back side, a top side, and a bottom side, and wherein the intonation portions are located at least partially on the front side of the elongated body.

14. The guitar of claim 12, wherein the number of intonation portions in the compensated nut is equal to the number of strings of the guitar.

15. The guitar of claim 12, wherein the intonation portions comprise a plurality of cut-out sections.

16. A lute-type instrument, comprising:

a body including a bridge;

a neck attached to the body;

a compensated nut connected to the neck, the nut having a front side and a bottom side, the nut including one or more cut-out sections on the front side, the one or more cut-out sections being disposed such that a line intersecting said one or more cut-out sections does not form a sinusoidal arc; and a plurality of strings extending from the bridge to the nut.

17. The lute-type instrument of claim 16, wherein the bottom side of the nut contacts the neck of the instrument and the front side of the nut faces the body of the instrument.

18. The lute-type instrument of claim 16, wherein the cut-out sections have different dimensions according to the desired pitch of the instrument.

19. The lute-type instrument of claim 16, wherein the number of cut-out sections in the nut is equal to the number of strings of the instrument.

20. A method of making an instrument with a plurality of strings, the instrument including a body, a neck and a bridge, comprising:

mounting a nut to the neck of the instrument, the nut including an elongated body with a front side, a back side, a top side, and a bottom side, the body having a length sufficient to extend across at least a portion of the neck of the stringed instrument, the nut including one or more fixed intonation portions on the front side of the elongated body, the intonation portions having different dimensions according to the desired pitch of the stringed instrument and the different dimensions of the intonation portions resulting in a nonsinusoidal configuration among the intonation portions;

extending the strings from the bridge to the nut; and attaching the strings to the bridge and the neck of the instrument.

21. A nut for a stringed instrument, comprising:

an elongated body;

a plurality of slots on a surface of the body; and fixed means for compensating the intonation of one or more strings of the instrument, the fixed means being nonsinusoidal in configuration.

22. A nut for a stringed instrument, comprising:

a substantially unitary elongated body, the body having a length sufficient to extend across at least a portion of the neck of the stringed instrument;

a plurality of slots across the elongated body configured to position corresponding strings; and a plurality of fixed string termination points along said elongated body, each termination point corresponding to one of said plurality of slots, at least one of said string termination points offset in distance from another of said termination points with respect to a line perpendicular to said strings, and said fixed termination points defining a nonsinusoidal line with respect to said line perpendicular to said strings.

23. The nut of claim 22, wherein at least three of said plurality of string termination points are offset from each other with respect to said line.

24. The nut of claim 23, wherein said offset is non-linear from termination point to termination point.

25. A compensated zero fret for a stringed instrument, the stringed instrument having one or more strings, a body and a neck, the zero fret comprising:

an elongated body having a length sufficient to extend across at least a portion of the neck of the stringed instrument; and one or more fixed intonation portions on the front side of the elongated body, the intonation portions having different dimensions according to the desired pitch compensation for each string and the intonation portions being configured such that a line extending through said fixed intonation portions does not form a sinusoidal arc.

26. The compensated zero fret of claim 25, wherein the number of intonation portions are equal to the number of strings of the instrument.

27. The compensated zero fret of claim 25, further including one or more slots extending along at least a portion of a top side of the nut, each of the slots configured to receive one of the strings of the instrument.

28. The compensated zero fret of claim 27, wherein each of the slots is aligned with one of the intonation portions.

29. The compensated nut of claim 1, wherein the intonation portions comprise a combination of inward cut-out sections and outward projections that extend outwardly from the nut.

* * * * *

US006433264C1

(12) EX PARTE REEXAMINATION CERTIFICATE (9936th)

United States Patent

Gimpel et al.

(10) Number: US 6,433,264 C1

(45) Certificate Issued: Nov. 13, 2013

(54) COMPENSATED NUT FOR A STRINGED INSTRUMENT

(75) Inventors: Dudley D. Gimpel, Alascadero, CA (US); Hans F. Lindauer, Los Osos, CA (US)

(73) Assignee: Ernie Ball, Inc., San Luis Obispo, CA (US)

Reexamination Request:
No. 90/012,599, Sep. 14, 2012

Reexamination Certificate for:

| | |
|---|---|
| Patent No.: | **6,433,264** |
| Issued: | **Aug. 13, 2002** |
| Appl. No.: | **09/199,747** |
| Filed: | **Nov. 25, 1998** |

(51) Int. Cl.

| | |
|---|---|
| ***G10D 3/00*** | (2006.01) |
| ***G10D 3/12*** | (2006.01) |
| ***G10D 3/06*** | (2006.01) |

(52) U.S. Cl.
USPC ..... 84/314 N

(58) Field of Classification Search
None
See application file for complete search history.

(56) References Cited

To view the complete listing of prior art documents cited during the proceeding for Reexamination Control Number 90/012,599, please refer to the USPTO's public Patent Application Information Retrieval (PAIR) system under the Display References tab.

*Primary Examiner* — Jason Proctor

(57) ABSTRACT

The present invention involves a solid compensated nut for a stringed musical instrument which improves the intonation of each string of the instrument. The compensated nut includes one or more intonation portions on a face of the nut and the intonation portions have different dimensions according to the desired pitch or intonation of the instrument. Desirably, the number of intonation portions is equal to the number of strings of the instrument, and each particular intonation portion is dimensioned to improve the intonation of a particular string. Advantageously, the nut is compensated different amounts according to the desired pitch of a particular string and the compensated nut is especially effective in improving the intonation of the strings near the nut.

At the time of issuance and publication of this certificate, the patent remains subject to pending reissue application number 13/858,449 filed Apr. 8, 2013. The claim content of the patent may be subsequently revised if a reissue patent is issued from the reissue application.

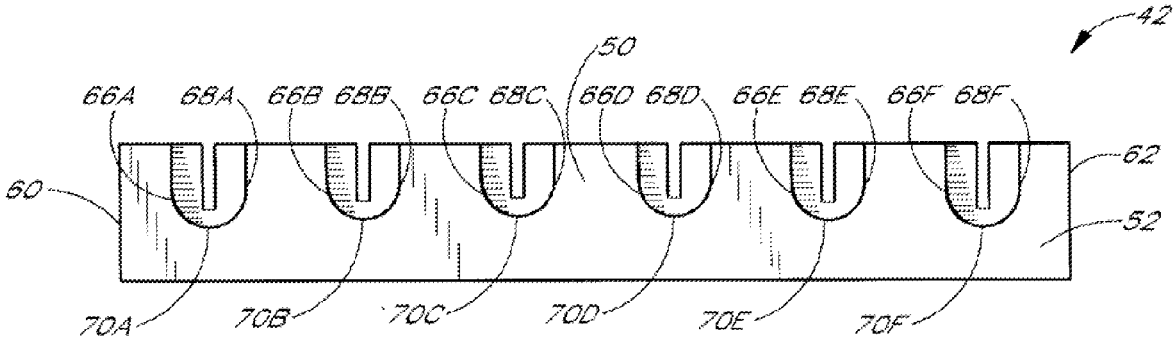

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 5, 19 and 25-28 is confirmed.

Claims 11-18, 20 and 29 are cancelled.

Claims 1-4, 6-10 and 21-24 were held invalid in a final decision by the Court of Appeals for the Federal Circuit. Ernie Ball, Inc. v. Earvana, LLC, No. 2012-1276 (Fed. Cir. Jan. 24, 2013), reh'g denied.

* * * * *